United States Patent [19]

Harris et al.

[11] 4,392,324

[45] Jul. 12, 1983

[54] MOUTH OPERABLE MASK DEVICE

[75] Inventors: Jeff Harris, Los Angeles; Charles A. Chambers, Burbank; Jack M. Horwitz, Los Angeles, all of Calif.

[73] Assignee: Minkey Farms Partnership, Los Angeles, Calif. ; a part interest

[21] Appl. No.: 290,389

[22] Filed: Aug. 5, 1981

[51] Int. Cl.[3] ..... A63H 33/00; A42B 1/18

[52] U.S. Cl. ..... 46/1 F; 46/175 R; 2/206

[58] Field of Search ..... 46/1 F, 175 R, 189, 46/190, 1 R, 154, 171; 2/206, 9, 174; D21/190

[56] References Cited

U.S. PATENT DOCUMENTS

| | | | |
|---|---|---|---|
| 587,687 | 8/1897 | Harder | 2/206 |
| 2,434,078 | 1/1948 | Malerman | 2/174 X |
| 2,504,679 | 4/1950 | Goldfarb | 46/189 |
| 3,439,447 | 4/1969 | Green | 46/175 R |
| 4,040,127 | 8/1977 | Slovitt et al. | 2/9 X |

*Primary Examiner*—Mickey Yu

*Attorney, Agent, or Firm*—Spensley, Horn, Jubas & Lubitz

[57] ABSTRACT

A face mask having an upper mask portion and a lower mask portion, each of which portions are connected respectively to two legs of a V-shaped element on which is inserted into the mouth of the mask wearer. A tooth grip provided on the V-shaped element allows the mask wearer to hold the mask firmly. Flexing of the V-shaped element at its hinge produces relative motion between the upper and lower mask portions. A metal element is attached to one leg of the V-shaped element for generating a clicking sound when the V-shaped element is flexed.

1 Claim, 3 Drawing Figures

MOUTH OPERABLE MASK DEVICE

BACKGROUND OF THE INVENTION

1. Field of the Invention

The present invention relates to a mouth operable mask device.

2. Description of the Prior Art

Prior art masks have generally consisted of a front face piece comprising a single rigid element. Regardless of the means by which the mask was attached to the face of the wearer, the various features and elements of the mask were fixed in position with respect to one another.

Other prior art masks have consisted of a front face piece comprising several elements. However, these various element were movable with respect to one another only by manual manipulation of the elements by the mask wearer or some other person. This extraneous manual manipulation thereby tended to destroy the visual illusion sought to be achieved by wearing the mask.

By contrast, it is an object of the present invention to provide a face mask in which various mask elements may be moved with respect to one another by means of a mask device held in the wearer's mouth. It is a further objective of this invention to enable the mask wearer to generate a noise whenever the mask elements are moved.

SUMMARY OF THE INVENTION

These and other objectives are achieved by incorporating within the mask a V-shaped element capable of being inserted into the mouth of the mask wearer. The upper portion of the mask is attached to one of the legs of this V-shaped element while the lower portion of the mask is attached to the other leg. A tooth grip provided on the V-shaped element allows the mask wearer to hold the mask firmly. Flexing of the V-shaped element at its hinge produces relative motion between the upper and lower mask portions.

BRIEF DESCRIPTION OF THE DRAWINGS

The detailed description of the invention will be made with reference to the accompanying drawing, wherein like numerals designate corresponding parts in the several Figures.

DESCRIPTION OF THE PREFERRED EMBODIMENT

The following detailed description is of the best presently contemplated mode of carrying out the invention. This description is not to be taken in a limiting sense, it is made merely for the purpose of illustrating the general principals of the invention since the scope of the invention best is defined by the appended claims.

Figure 3:
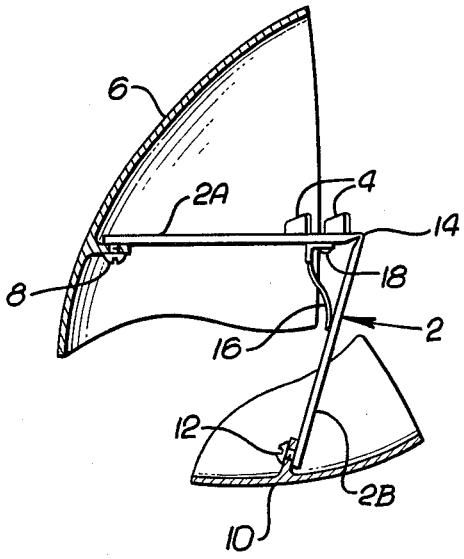
FIG. 3 is a vertical sectional view of the present invention in an open position.

Referring to the Figures, a V-shaped acutating element 2 is provided which includes an upper leg 2A and lower leg 2B. The V-shaped element 2 is composed of a resilient plastic material which is flexible along the hinge 14. The resiliency of this plastic material at the hinge 14 biases the legs 2A and 2B of the V-shaped element 2 in an open position, as shown in FIG. 3. The entire V-shaped element 2 is of a size and configuration which allows it to be easily inserted into the mouth of a mask wearer.

In order for the mask wearer to hold the mask firmly to his face, braces 4 are provided on the exterior surface of upper leg 2A. In the embodiment of the invention shown, the braces 4 are designed so that the front face of each brace 4 can abut the rear face of the wearer's upper front teeth. In the preferred embodiment of the invention at least two such braces 4 are provided to accommodate mask wearers having mouths of different sizes.

Upper mask portion 6 is attached to upper leg 2A by means of a screw 8. Lower mask portion 10 is attached to lower leg 2B by means of a screw 12. Although it is understood that the upper mask portion 6 and lower mask portion 10 may be of any design, in the embodiment shown of the invention the upper and lower mask portions resemble a chicken beak. Flexing of V-shaped element 2 along hinge 14 will produce relative motion between the upper mask portion 6 and the lower mask portion 10.

A metal element 16 is attached to upper leg 2A by means of a screw 18. The unattached end of metal element 16 is in contact with lower leg 2B so that relative motion between legs 2A and 2B will cause metal element 16 to bend. Metal element 16 is designed so that it produces a klicking noice when V-shaped element 2 is flexed along hinge 14.

To operate, the mask wearer places the hinged end 14 of the V-shaped element 2 into his or her mouth. Initially the V-shaped element 2 is in a biased open position, so that upper mask portion 6 and lower mask portion 10 are positioned apart. The upper teeth of the mask wearer are placed against braces 4 on the upper leg 2A, while the mask wearer's lower teeth rest against the exterior surface of the lower leg 2B.

Figure 1:
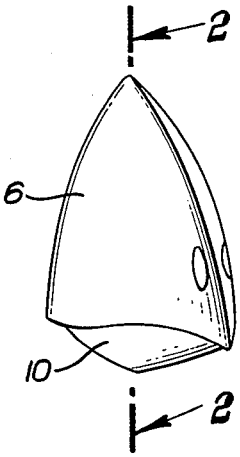
FIG. 1 is a left front perspective view of a toy mask incorporating the present invention.
Figure 2:
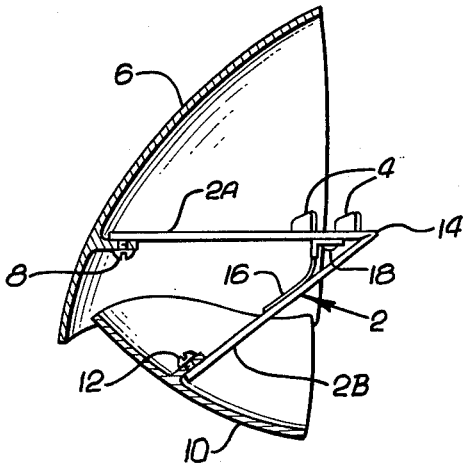
FIG. 2 is a vertical sectional view of FIG. 1 taken along line 2—2.

As the mask wearer closes his or her jaw, hinge 14 flexes so that upper and lower legs 2A and 2B are brought closer to each other. This in turn brings upper mask portion 6 and lower mask portion 10 closer together until the upper and lower mask portions are in contact. V-shaped element 2 has a beveled inner edge along hinge 14, thus restricting relative motion when the upper mask portion 6 and the lower mask portion 10 are in the closed position as seen in FIG. 2.

In summary, the present invention comprises a face mask in which upper maske portion 6 and lower mask portion 10 may be moved with respect to one another by means of flexing a V-shaped element 2 held in the wearer's mouth. In addition, the bending of metal element 16 enables the mask wearer to generate a noise whenever the V-shaped element 2 is flexed.

What is claimed is:

1. A mouth operable mask comprising:

a flexible V-shaped element capable of being inserted into the wearer's mouth;

at least one brace, attached to one of the legs of said V-shaped element, which may be gripped by the wearer's teeth;

an upper mask portion attached to one of the legs of said V-shaped element and a lower mask portion attached to the other of the legs of said V-shaped element, whereby flexing of said V-shaped element produces relative motion between said upper and lower mask portions;

wherein said V-shaped element includes a flexible hinge composed of resilient plastic whereby the resiliency of said hinge biases said V-shaped element in an open position; and a metal element attached to the interior side of one of said legs of said V-shaped element and being in contact with the interior side of said other of said legs, wherein said metal element generates a clicking noise when said V-shaped element is flexed.

* * * * *